United States Patent [19]

Soutsos

[11] 4,324,157

[45] Apr. 13, 1982

[54] DRILL PIPE CLAMP

[76] Inventor: Michael D. Soutsos, 5475 Colorado St., Long Beach, Calif. 90814

[21] Appl. No.: 115,911

[22] Filed: Jan. 28, 1980

[51] Int. Cl.[3] ..... B25B 17/00

[52] U.S. Cl. ..... 81/57.17

[58] Field of Search ..... 81/57.17; 294/111, 21; 308/188, 189 R

[56] References Cited

U.S. PATENT DOCUMENTS

| | | | |
|---|---|---|---|
| 449,957 | 4/1891 | Simonds | 308/188 |
| 611,236 | 9/1898 | Crane | 308/188 |
| 3,906,820 | 9/1975 | Hauk | 81/57.17 |
| 4,212,212 | 7/1980 | Chandler et al. | 81/57.17 |

*Primary Examiner*—James L. Jones, Jr.
*Attorney, Agent, or Firm*—I. Michael Bak-Boychuk

[57] ABSTRACT

A clamp for drill pipes includes an hydraulic motor adapted to drive a gear head which is keyed to a sprocket engaged to a sheave chain. The sprocket and the associated equipment are mounted between two plates which are also provided with an hydraulically operated slide for advancing two rollers. It is these rollers that, by their advancement, enlarge or shorten the effective sheave chain loop, the sheave chain passing over idlers towards the end of two hinged arms or jaws which are conformed to receive the drill pipe. Formed at the end of each jaw are bearing seats each adapted to receive a bearing cap which engages ball bearings in corresponding bearing races supporting the center shaft of two turning sprockets around which the chain is looped. Each of the bearing races includes an enlarged periphery and it is between this periphery and the chain loop that the pipe is engaged. In this manner pipes of various sizes may be clamped on the interior of the jaws and the rotation of the hydraulic motor can then drive the pipe.

1 Claim, 6 Drawing Figures

FIG. 4
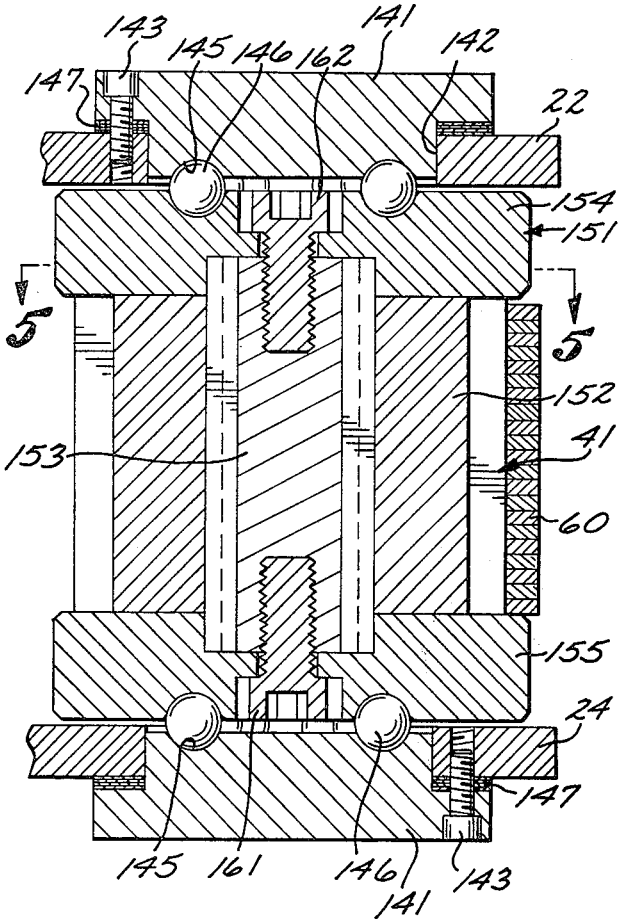
FIG. 5
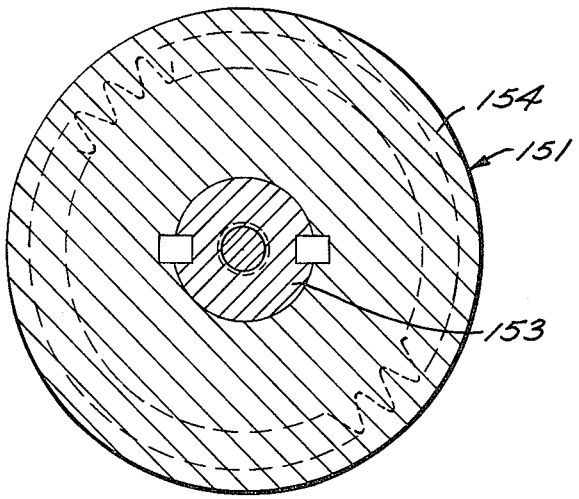
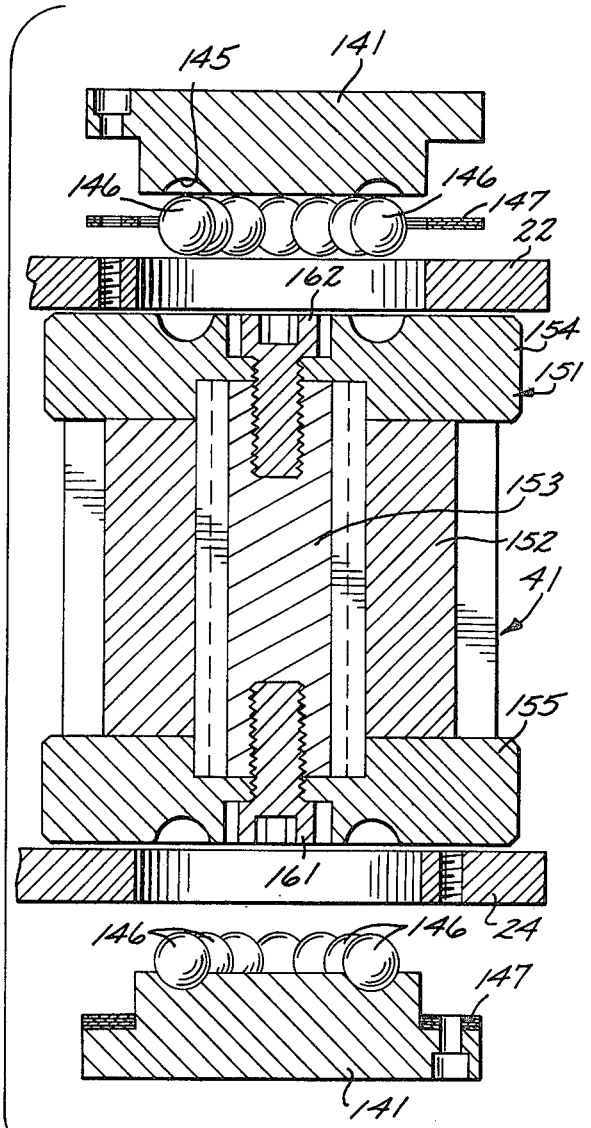
FIG. 6

DRILL PIPE CLAMP

BACKGROUND OF THE INVENTION

1. Field of the Invention

The present invention relates to drill pipe turning devices, and more particularly to drill pipe clamps provided with a rise advance.

2. Description of the Prior Art

The use of clamps to retain and rotate a drill pipe has been known in the past. With the recent shortages of oil drilling techniques entailing extraordinary depth have raised the force levels necessary at the surface to a point where wear and structural failure are now a common occurrence. Thus the typical costing of a well bore almost always includes the costing of equipment replacement, an item heretofore amortized over several jobs.

There is therefore a constant search for techniques that result in higher structural strength available from equipment which is also compact to allow for the same manipulative convenience that the personnel is accustomed to. This structural integrity is to be accommodated in a device which also is conveniently adjusted for wear thus enhancing the useful life thereof and reducing the equipment costs.

SUMMARY OF THE INVENTION

Accordingly, it is the general purpose and object of the present invention to provide a drill pipe clamp which in the structure thereof includes provisions for convenient adjustment.

Yet additional objects of the present invention are to provide a pipe clamp for use with drill pipes which is convenient in use and easy to maintain.

Briefly these and other objects are accomplished within the present invention by providing a pipe clamp assembly having two pivotal jaws at one end thereof and a plurality of rollers around which a sheave chain loop is wound. The jaws, proximate the ends thereof, includes two end sprockets each provided with a cap of substantially larger diameter, the cap forming a seat for ball bearings which are engaged in yet another seat mounted in each jaw. The assembly itself is generally conformed from two parallel plates between which the foregoing rollers and sprockets are mounted. Formed on the exterior of these plates is an hydraulically operated sliding mechanism to which two of the rollers are attached. It is by virtue of this hydraulically operated sliding mechanism that the convolutions of the chain loop can be altered. Thus the length of chain extending on the exterior of the jaws may be adjusted, accommodating various diameters of pipe that may be inserted therebetween. Once inserted the pipe may be clamped for rotation by way of the sliding articulation of the adjusting mechanism which concurrently closes the jaws. To provide for rolling contact between the pipe and the jaws each of the end races on the jaw sprocket are provided with enlarged peripheral flanges which extend beyond the thickness of the chain. Thus the pipe over a part of the circumference thereof is engaged to the chain links, the other segments of the pipe being directly in contact with the bearing race. When so engaged the pipe may be turned by way of a hydraulic motor which is keyed to drive one of the sprockets. The pipe, resting on the bearing races, can then be driven in rotation while the chain is maintained taut by the sliding mechanism.

Since the maximum stresses that occur are at the jaw sprockets each of the enlarged bearing races forms one part of the bearing assembly, the other part of the bearing assembly being formed by way of a cap directly received in the jaw. It is contemplated to dimension the spacing between the two bearing races on each of the jaw sprockets such that the removal of the cap will allow for the withdrawal of each jaw sprocket. In this manner items exposed to maximum wear are conveniently available for inspection and repair without disturbing the rest of the mechanism. Furthermore, the engagement of the caps to the respective jaws may be across a plurality of shims and it is the selection of these shims that may be used to accommodate normal race wear.

BRIEF DESCRIPTION OF THE DRAWINGS

FIG. 4 is a sectional view of one jaw sprocket taken along the line 4—4 of FIG. 1;

FIG 5 is yet another sectional view, taken along line 5—5 of FIG. 4; and FIG. 6 is an illustration by parts of the jaw sprocket shown in FIG. 4.

DESCRIPTION OF THE SPECIFIC EMBODIMENT

Figure 1:
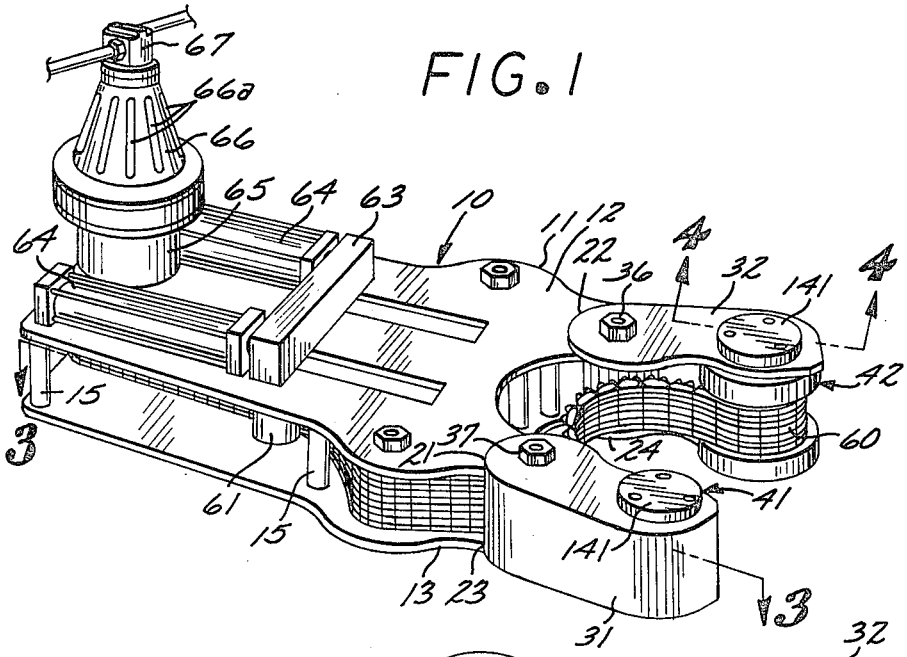
FIG. 1 is a perspective illustration of a drill pipe clamp assembly constructed according to the invention herein.
Figure 2:
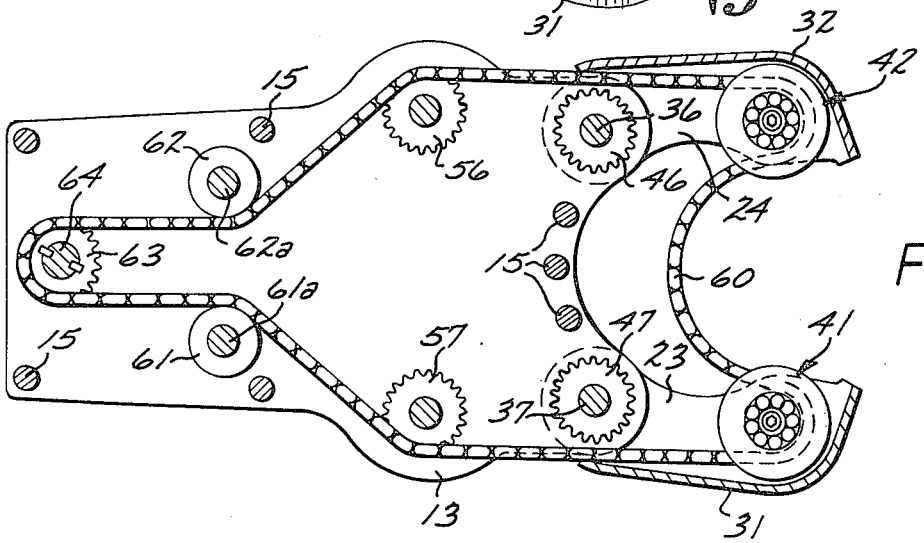
FIG. 2 is a top view, in section, of the clamp assembly shown in FIG. 1, illustrating the extended position thereof.
Figure 3:
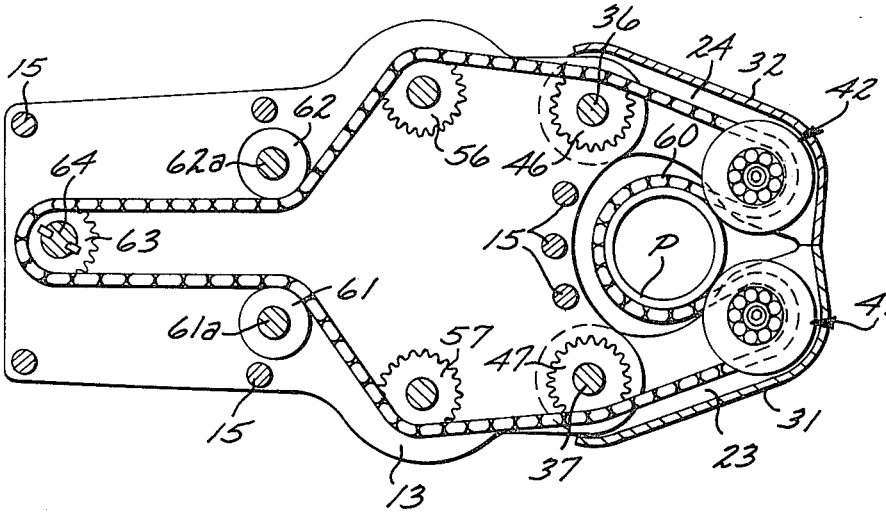
FIG. 3 is yet another top view, in section, of the inventive pipe clamp assembly, illustrating the closed articulation thereof.

As shown in FIGS. 1, 2 and 3 the inventive clamp assembly, generally designated by the numeral 10, comprises a frame 11 formed by way of two parallel plates 12 and 13 joined by a plurality of cylindrical spacers 15 to form a gap therebetween. In plan form each of the plates 12 and 13 is shaped substantially like a fork including forked ends 21 and 22 and 23 and 24 at the respective one edge thereof. It is these forked ends or arms 21 through 24 that provide a pivotal attachment for two pivotal jaw assemblies 31 and 32, each conformed generally as a channel shaped structure receiving respectively the foregoing pivot supporting arms 21–24 on the interior thereof. More specifically jaw assembly 32 is pivoted from a pivot pin 36 which also engages plates 12 and 13 at arms 22 and 24. Jaw 31, in a similar manner, is pivoted on a pin 37 engaging arms 21 and 23. In this form jaws 31 and 32 are free to articulate about the ends of the frame assembly 11 to receive the lateral surfaces of a drill pipe P therebetween.

It is contemplated to accommodate drill pipes of various diameters within the confines of the aforementioned jaws and for this purpose the interiorly opposed edges of the jaws are cut away as well as the end edge of plates 12 and 13. Each of the jaws 31 and 32, furthermore, at the free ends thereof, includes a clamping sprocket assembly 41 and 42 respectively, the structure of these clamping or jaw sprocket assemblies being identical for the purposes of disclosure herein. These sprocket assemblies together with a pair of hinge sprockets 46 and 47 respectively mounted on hinge pins 36 and 37 and two turning sprockets 56 and 57 mounted for rotation between plates 12 and 13 guide a continuous loop of a sheave chain 60. This sheave chain 60 extends between two tensioning rollers 61 and 62 to a drive sprocket 63 keyed to a shaft 64 which extends into the interior of a gear head 65. Gear head 65 through a conical adapter 66 engages an hydraulic motor 67 and it thus drives the chain about the aforementioned sprockets.

As previously stated, chain 60 passes between tensioning rollers 61 and 62 and it is these tensioning rollers that change the effective length of the chain between the jaw sprockets 41 and 42. More specifically, tensioning rollers 61 and 62 are mounted on two roller posts 61*a* and 62*a* which, in turn, are attached to a sliding frame 63 actuated by hydraulic actuators 64. Thus, the convolutions in the path of chain 60 may be altered by the longitudinal articulation of rollers 61 and 62, altering the looped dimension of the chain segment between the jaw sprocket assemblies 41 and 42 and thus altering or accommodating the pipe size grasped therebetween.

As shown in FIGS. 1, 4, 5 and 6, each of the sprocket assemblies 41 and 42 is retained within the corresponding pivoted jaw by end caps 141. It is to be understood that for purposes of this description detail is directed to sprocket assembly 41, sprocket assembly 42 being constructed in an identical manner. End caps 141 are received in opposed bores 142 formed in the jaw, being attached to the jaw by way of a plurality of fasteners 143. Formed on the interior face of end cap 141 is a ball race 145 dimensioned to align within the interior of the bore 142. Thus the interior channel section or the pocket of each of the jaws 41 and 42 form the limiting dimension. It is within this limiting dimension that a sprocket 151 is inserted comprising a sprocket gear 152 keyed to a center shaft 153 which also extends in a keyed manner into the interior of two races 154 and 155 at the ends thereof. Races 154 and 155 are shaped to a diameter larger than the diameter of sprocket gear 152 to a sufficient clearance to accommodate the chain therein. Thus the pipe P when placed between the jaws 41 and 42 will abut the peripheral edges of the races 154 and 155 and only that portion of the chain 60 that extends therebetween is brought in intimate contact with the pipe. Since the peripheral edges of the ball races 154 and 155 will therefore be advanced at a rate higher than the rate of advance of the chain, an effective redistribution of loading occurs. More specifically, ball race 145 engages a plurality of roller balls 146 which also engage ball races 154 and 155. It is through these balls 146 that the force is transferred from the sprocket assembly into the corresponding jaw. When the cap 141 is removed the balls are free to be displaced and the sprocket assembly can thus be conveniently withdrawn without disruption of the rest of the structure. Furthermore by way of a plurality of shims 147 between the cap 141 and the adjacent structure of the jaw, it is possible to adjust the depth of ball contact as wear occurs. Once removed, the races 154 and 155 may be dismounted from the keyed shaft 153 by loosening two allen screws 161 and 162. According to this structural arrangement individual replacement of worn parts can be conveniently achieved in minimal time and without major disassembly. Specifically, once the end clamps 141 are removed the restraint on balls 146 is also removed and manual dismounting can then proceed. This same structure provides additional benefits in that all or most of the jaw loads is transferred through ball rollers. By virtue of the enlarged periphery of seats 154 and 155 further load distribution can be achieved whereby the rollers of one jaw are loaded and worn to a similar extent as the rollers of the other jaw.

In addition, the integral manner in which the foregoing structure is achieved allows for convenient element replacement such as for example the hydraulic motor 67. In particular, adapter 66 is provided with elongate slots 66*a* which are of sufficient size to permit the insertion of tools but which are smaller than the normal dimensions of the body parts of an operator. Thus a safe and reliable structure is formed which conveniently adapts to various drill pipe diameters and which can be field serviced in minimal time.

Obviously many modifications and changes can be made to the foregoing description without departing from the spirit of the invention. It is therefore intended that the scope of the invention be determined solely on the claims appended hereto.

What is claimed is:

1. In a clamp assembly for use in manipulating drill pipes including a frame having an upper and lower plate joined together across a plurality of spacers to form a gap therebetween, a pair of pivotal jaws pivotally attached to one end of said frame and disposed for pivotal motion in a plane substantially parallel with said upper and lower plates; a plurality of first sprockets mounted for rotation within said gap, a plurality of second sprockets mounted for rotation at the free ends of said jaws, each said second sprocket including an enlarged ball race assembly at the upper and lower ends thereof and a sheave chain loop disposed around said first and second sprockets and aligned to pass between said ball race assemblies, the improvement comprising:

said ball race assemblies each including opposed fixed and rotary mating circular surfaces each provided with a ball groove for retaining roller balls therebetween, said fixed surfaces being releasably attached to said pivotal jaws and said rotary surfaces being attached to said second sprockets whereby the release of said fixed surfaces allow for withdrawal of said second sprockets from said jaws.

* * * * *